United States Patent [19]

Prokesch

[11] Patent Number: 4,586,626

[45] Date of Patent: May 6, 1986

[54] DEVICE FOR COVERING A RECESS IN A TILED WALL

[76] Inventor: Albin Prokesch, Goethestrasse 57, A-4020 Linz, Austria

[21] Appl. No.: 764,537

[22] Filed: Aug. 12, 1985

[30] Foreign Application Priority Data

Aug. 28, 1984 [AT] Austria ..... 2741/84

[51] Int. Cl.[4] ..... B65D 41/04; B65D 41/34

[52] U.S. Cl. ..... 220/334

[58] Field of Search ..... 220/3.7, 3.8, 18, 334, 220/256, 259

[56] References Cited

U.S. PATENT DOCUMENTS 3,187,922 6/1965 Hoskins et al. ..... 220/3.7

3,199,713 8/1965 Flackfarth ..... 220/3.7

*Primary Examiner*—George T. Hall

*Attorney, Agent, or Firm*—Kurt Kelman

[57] ABSTRACT

A device for covering a recess in a tiled wall comprises a receptacle, which is adapted to be inserted into the recess and to accommodate a tile cover, which is connected to the receptacle by pivotal mounting means, which act on supporting lugs, which are provided on the receptacle and extend normal to the plane in which the tile cover extends in its closed position. To provide cover-retaining means which are particularly simple and can be combined with any different receptacles, the pivotal mounting means consist of separate hinges, which are provided on one side of the receptacle adjacent to two corners thereof. Each of the supporting lugs which carry the hinges comprises a lanced retaining tongue, which is adapted to be anchored in a side face of the recess.

6 Claims, 2 Drawing Figures

DEVICE FOR COVERING A RECESS IN A TILED WALL

BACKGROUND OF THE INVENTION

1. Field of the Invention

This invention relates to a device for covering a recess in a tiled wall, comprising a receptacle, which is adapted to be fitted into the recess, and a tile cover, which is connected to the receptacle by pivotal mounting means and adapted to be accommodated by the receptacle, wherein said pivotal mounting means are connected to the receptacle at lugs, which are provided on the receptacle and extend normal to the plane of the tile cover in its closed position.

2. Description of the Prior Art

In order to permit an access to technical equipment and fittings accommodated in the recess, the cover is detachably held in the receptacle in most cases by screw means or magnetic fasteners. The cover may be combined with different receptacles, which may consist, e.g., of fixed or adjustable frames or of segments adapted to be individually installed. But the handling of such known covers is rather complicated because when the recess is to be opened the cover must be held with both hands and removed and laid aside and the cover must be carefully fitted into the receptacle to close the recess. Whereas hinged covers can be handled more conveniently, they have not been successful thus far because the conventional receptacles embedded in the recess or between the masonry and the tiles are held in place only by relatively weak joints unless complicated operations involving the masonry are performed. For this reason the receptacles cannot support the cover as firmly as would be required for a hinged mounting. Besides, such receptacles should be as unconspicuous as possible from the outside and for this reason consist of thin sheet metal elements or sections and will not withstand any substantial load.

It is apparent from French Pat. No. 2,505,921 that covering devices having a hinged cover are known but the receptacle associated with that cover consists of a strong frame, which is provided with peripheral supporting lugs, which have fixing flanges interlocking with the masonry. The means for pivotally mounting the cover comprise mutually opposite hinge pins, which are centrally provided on the frame and received by mating bearing eyes of the cover so that the latter is pivoted on a centrally disposed transverse axis. That covering device has an expensive frame and its installation requires complicated preparatory and installing operations. Besides, it can be used only with recesses which are so deep that they permit the cover to be swung open, and that known device is an appreciable disturbance in the otherwise uniform appearance of the tiled wall. For these reasons the use of the known covering device is restricted in spite of the high expenditure involved.

SUMMARY OF THE INVENTION

It is an object of the invention to avoid the disadvantages set forth hereinbefore and to provide a covering device which is of the kind described first hereinbefore and which distinguishes by comprising cover-mounting means which are particularly simple, of universal application and adapted to be combined with any desired receptacle.

This object is accomplished in accordance with the invention in that the pivotal mounting means consist of hinges, which are provided at coner portions of the receptacle, and that the hinges are carried by supporting lugs, which comprise lanced retaining tongues for anchoring the cover in the side faces of the recess. If the tile cover has a substantial size, it will consist of a baseplate and of tiles adhesively joined to said baseplate. The hinges are secured to the cover adjacent to one edge thereof so that the covers are pivotally movable about an axis which substantially coincides with that adjacent edge. As a result, during the opening movement the cover will not enter the recess so that problems caused by space restrictions will not arise. It will be sufficient to secure the hinges to the supporting lugs at such a depth that the surface of the cover is aligned with the tiles on the wall, possibly with an allowance for the thickness of any baseplate. After such a fixation the desired covering device has been completed, which has an attractive appearance and can be conveniently opened and closed. The supporting lugs are reliably supported at the corners and are anchored directly in the side faces of the recess so that said lugs can reliably take up a major part of the loads which are due to the hinged mounting. As a result, the receptacle will remain virtually free from any additional load and there will be no overstressing of the receptacles even if they are thin and held in the recess by low-strength joints. The retaining tongues of the supporting lugs can easily be embedded in a mortar layer as the receptacle is installed and the installation work is small and comparable to that involved in the installation of conventional receptacles. If the supporting lugs are angled to conform to the corners of the recess, the stiffness and strength of the supporting means will be further increased and it will even be possible to provide a receptacle which consists only of separate corner members so that the present covering device can be used in a particularly economical manner regardless of the size of the cover and of the recess.

DETAILED DESCRIPTION OF THE PREFERRED EMBODIMENT

Figure 1:
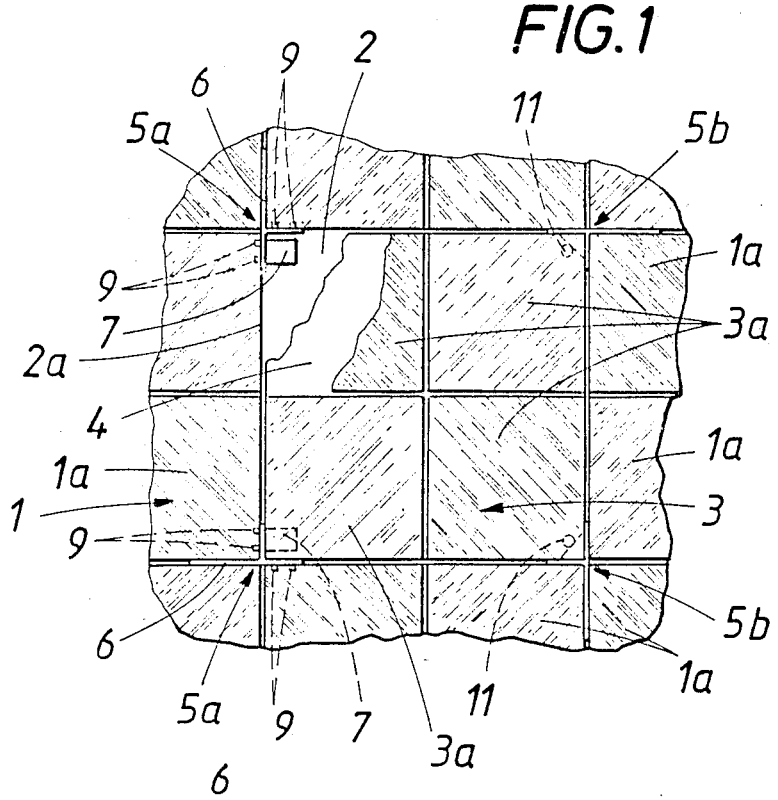
FIG. 1 is a top plan view showing a covering device which embodies the invention.
Figure 2:
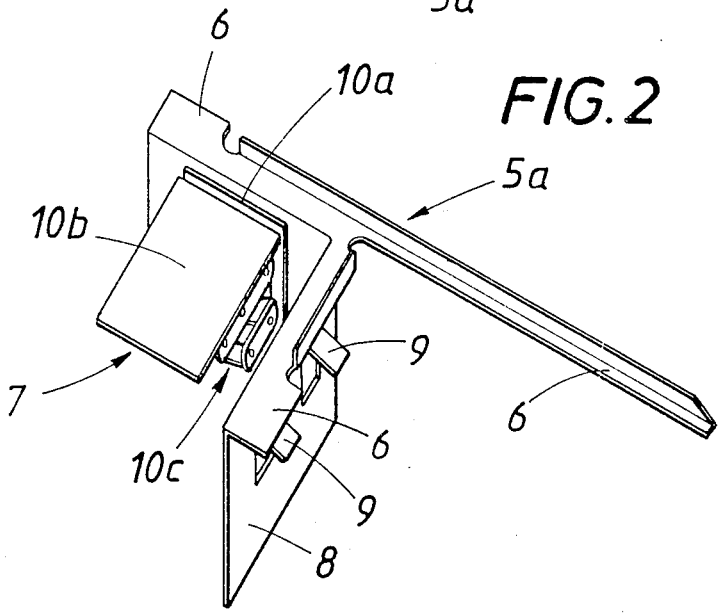
FIG. 2 is a perspective view showing on a larger scale a portion of the receptacle of the covering device of FIG. 1.

Fittings and/or technical equipment are accommodated in a polygonal, preferably rectangular recess 2, which is formed in a tiled wall 1. That recess 2 is covered by means which do not appreciably disturb the appearance of the tiled wall. Said means comprise a rectangular tile cover 3, which comprises a baseplate 4 and four tiles 3*a*, which are the same as the tiles 1*a* on the wall and adhesively fixed to the baseplate 4. The cover 3 is accommodated by a receptacle, which consists of four identical corner members 5*a*, 5*b*, each of which is fitted in a corner of the recess 2 and which are fixed by fixing tongues 6, which have been slidably inserted between the wall tiles 1*a* and under the latter. To permit a convenient opening and closing of the tile cover 3, the corner members 5*a* carry respective hinges 7, which are connected to the cover 3. For the fixation of said hinges 7, each corner member 5*a* is provided with a supporting lug 8, which has the same configuration as the corner member 5*a*. Each backing lug 8 is formed with a lanced retaining tongue 9 for anchoring the lug 8 in the side face 2*a* of the recess 2 so that the loads which are due to the hinges can be taken up without difficulty. Each hinge 7 comprises two mounting plates 10*a* and 10*b*, which are receptively connected to the receptacle and to the tile cover 3. The mounting plate 10*a* is secured to the supporting lug 8 and the mounting plate 10*b* is secured to the baseplate 3*a*. When the cover is closed, the mounting plates 10*a* and 10*b* are at right angles to each other. As the hinge is opened, the mounting plate 10*b* is initially raised relative to the mounting plate and is then swung open. For this purpose the mounting plates 10*a*, 10*b* are interconnected by two links 10*c*, as is indicated in FIG. 2, which together with the mounting plates 10*a*, 10*b* constitute a four-bar linkage.

The corner members 5*b*, which are opposite to the corner members 5*a*, do not carry hinges but permanent magnets 11, which cooperate with the ferromagnetic baseplate 4 of the cover 3 and retain the latter in its closed position. The resulting covering device can easily be adapted to and installed in recesses which differ in size and its cover can conveniently be opened and closed and will always exactly fit the receptacle.

I claim:

1. In a device for closing a polygonal recess in a tiled wall, comprising receptacle means, which comprise corner portions and are adapted to be fitted in said recess so that said corner portions extend in a plane, said receptacle means comprising supporting lugs adapted to extend normal to said plane, a tile cover adapted to assume relative to said receptacle means a closed position in which said cover extends in said plane, and pivotal mounting means supported by said lugs and pivotally connecting said cover to said receptacle and permitting said cover to be pivotally moved between said closed position and an open position, the improvement residing in that two of said supporting lugs are provided on two adjacent ones of said corner portions, said pivotal mounting means comprise two hinges, each of which is secured to said receptacle means adjacent to one of said lugs and is secured to said cover, and each of said lugs comprises a lanced retaining tongue, which is adapted to be anchored in said wall at a side face of said recess.

2. The improvement set forth in claim 1, in which each of said hinges is secured to one of said lugs.

3. The improvement set forth in claim 1, wherein said receptacle means consist of four separate corner members, which constitute respective ones of said corner portions.

4. The improvement set forth in claim 1, wherein each of said hinges consists of a multi-pivot hinge.

5. The improvement set forth in claim 1, wherein said cover is rectangular and said receptacle comprises four of said corner portions, which are right-angled.

6. The improvement set forth in claim 1, wherein each of said hinges comprises a four-bar-linkage.

* * * * *